US007916018B2

(12) United States Patent
Eskildsen et al.

(10) Patent No.: US 7,916,018 B2
(45) Date of Patent: Mar. 29, 2011

(54) WIRELESS DOOR CONTACT SENSOR WITH MOTION SENSOR DISABLE

(75) Inventors: Kenneth G. Eskildsen, Great Neck, NY (US); David S. Zakrewski, Babylon, NY (US); Gordon G. Hope, Miller Place, NY (US)

(73) Assignee: Honeywell International Inc., Morristown, NJ (US)

( * ) Notice: Subject to any disclaimer, the term of this patent is extended or adjusted under 35 U.S.C. 154(b) by 455 days.

(21) Appl. No.: 11/800,155

(22) Filed: May 4, 2007

(65) Prior Publication Data

US 2008/0157964 A1 Jul. 3, 2008

Related U.S. Application Data

(60) Provisional application No. 60/878,011, filed on Dec. 29, 2006.

(51) Int. Cl.

| | |
|---|---|
| ***G08B 29/00*** | (2006.01) |
| ***G08B 19/00*** | (2006.01) |
| ***G08B 1/08*** | (2006.01) |
| ***G08B 13/00*** | (2006.01) |
| ***G08B 13/08*** | (2006.01) |

(52) U.S. Cl. ..... 340/545.1; 340/506; 340/521; 340/531; 340/540; 340/541; 340/539.26; 340/545.6; 340/539.1

(58) Field of Classification Search ..... 340/540, 340/541, 545.1, 545.6, 539.1, 539.26, 506, 340/521, 531

See application file for complete search history.

(56) References Cited

U.S. PATENT DOCUMENTS

| | | | | |
|---|---|---|---|---|
| 3,582,870 | A * | 6/1971 | Peterson et al. | 367/94 |
| 4,225,858 | A * | 9/1980 | Cole et al. | 340/554 |
| 5,196,826 | A * | 3/1993 | Whiting | 340/554 |
| 5,225,806 | A * | 7/1993 | Stanley-Arslanok et al. | 340/541 |
| 5,309,144 | A * | 5/1994 | Lacombe et al. | 340/539.23 |
| 5,473,311 | A | 12/1995 | Hoseit | |
| 6,057,764 | A * | 5/2000 | Williams | 340/572.1 |
| 6,081,193 | A * | 6/2000 | Trucchi et al. | 340/541 |
| 6,426,703 | B1 * | 7/2002 | Johnston et al. | 340/628 |
| 6,950,017 | B2 * | 9/2005 | Smith | 340/521 |
| 7,132,941 | B2 * | 11/2006 | Sherlock | 340/539.26 |
| 7,504,942 | B2 * | 3/2009 | Marman | 340/541 |
| 2003/0071724 | A1 * | 4/2003 | D'Amico | 340/506 |

* cited by examiner

*Primary Examiner* — Benjamin C Lee
*Assistant Examiner* — Lam P Pham
(74) *Attorney, Agent, or Firm* — Husch Blackwell LLP

(57) ABSTRACT

A system and method for securing a structure, such as a residence or other building, against intrusion, while reducing generation of false alarms when an occupant of the structure inadvertently trips a contact detector by opening an entry point (door, window, etc.) is provided. The contact detector is coupled with a motion detector that is directed to monitor motion within the structure at a location proximate to the entry point being monitored by the contact detector. Generally, when the contact detector detects that the entry point is being opened, a fault is issued to a control panel, which in turn generates an alarm. However, if motion is detected within the structure and proximate to the entry point prior to the contact detector registering an opening of the entry point, no fault is generated.

33 Claims, 3 Drawing Sheets

WIRELESS DOOR CONTACT SENSOR WITH MOTION SENSOR DISABLE

CROSS REFERENCE TO RELATED APPLICATIONS

This application claims benefit of U.S. Provisional Application Ser. No. 60/878,011, filed Dec. 29, 2006, the entire contents of which is incorporated herein by reference.

FIELD OF THE INVENTION

The present invention relates generally to security systems and more specifically, the present invention relates to wireless door contact with a motion sensor disable for use in a security system.

BACKGROUND OF THE INVENTION

Security systems use a variety of sensors for detecting intrusions into a secured area. Some of the commonly used sensors include motion detectors, heat sensors, shock sensors, and door and window contact sensors. These sensors in combination can provide very good security against intrusion.

Security systems monitor sensors to determine the presence of people within a protected space. If the security system detects a breach of the protected space it will respond based on the arming state of the security system. Possible security system states include "Disarmed", "Armed Stay", and "Armed Away". If the system is set to "Disarmed" it will not alarm to perimeter or interior sensors. If the security system is set to "Armed Stay" the security system will sound an alarm at the occurrence of a breach of the perimeter sensors, but not to a breach of the interior sensors. If the system is set to "Armed Away" it will alarm to a breach of the perimeter or interior sensors. The state of the system is determined by the needs of the occupants of the premises. If all of the occupants are leaving the premises then the security system should be set to "Armed Away". If the occupants will be staying within the premises for an extended period of time then the security system should be set to "Armed Stay". For all other scenarios the security system should be set to "Disarmed".

Problems arise when the security system is not properly armed or disarmed. Typical problems include not setting the security system upon entry to "Disarmed" before the alarm sounds, setting the security system to "Armed Away" when occupants plan to stay within the protected space, not setting the security system to "Armed Away" when the premises are un-occupied, and not disarming the system when the security system is set to "Armed Stay" before a window or door is opened. Consequently, the security system incorrectly detects this action as an indication of an intrusion and sounds an alarm or notifies a monitoring station or police department.

These are user created problems and as such, it is desirable to provide a security system that assists the end user with the arming and disarming operations. Specifically, an object of the present invention is providing a security system that does not sound an alarm if an occupant opens a window or door from within the protected space when the security system is set to the "Armed Stay" mode. This is a common occurrence as the occupants of a protected space may open a window for fresh air or open a door to let a pet out without disarming the system first.

SUMMARY OF THE INVENTION

An object of the present invention is providing detection of unauthorized opening of an entry point, such as a window or door, while overriding generation of a fault when the entry point is opened by an occupant of the structure.

This invention addresses this need by adding a passive infrared sensor to a door/window sensor. The infrared sensor is used to detect motion from within the protected space and disable (locally) the door/window contact for a predetermined period of time. In addition, the contact will remain disabled for the duration that the door or window is open. The IR sensor is mounted such that motion from pets within the space is not be detected.

A contact sensor assembly for a security system is disclosed, having a contact sensor for detecting an opening of an entry point, a motion detector for detecting motion in an area inside of the structure proximate to the entry point, and a controller for generating a fault when the contact sensor detects the opening of the entry point. The entry point may be a door or window. Additionally the contact sensor assembly may include a transmitter for transmitting the generated fault to a control panel of the security system. The control panel generates an alarm upon receipt of the fault.

A method for securing a structure is also disclosed. The method determines an Armed state of a security system having a contact sensor positioned on an entry point of the structure and a motion detector. Motion is monitored in an area inside of the structure proximate to the entry point by the motion detector. The method also provides for monitoring a status of the entry point by the contact sensor. A fault is generated when the contact sensor detects an opening of the entry point. However, if motion is detected, then generation of the fault is suppressed or overridden.

Further, the present invention provides a security system for securing a structure. The security system includes a control panel for controlling detectors adapted for detecting security breaches in a structure. The control panel generates an alarm in response to receiving a fault signal from one of the detectors. A contact detector for detecting an opening of an entry point to which the contact sensor is attached and generating the fault signal when the opening is detected is also included in the security system. The sensor has a contact sensor for detecting the opening of the entry point, a motion detector for detecting motion in an area inside of the structure proximate to the entry point, and a controller for generating a fault signal when the contact sensor detects the opening of the entry point.

BRIEF DESCRIPTION OF THE DRAWINGS

These and other features, aspects, and advantages of the present invention will become better understood with regard to the following description, appended claims, and accompanying drawings wherein:

DETAILED DESCRIPTION OF THE INVENTION

Figure 1:
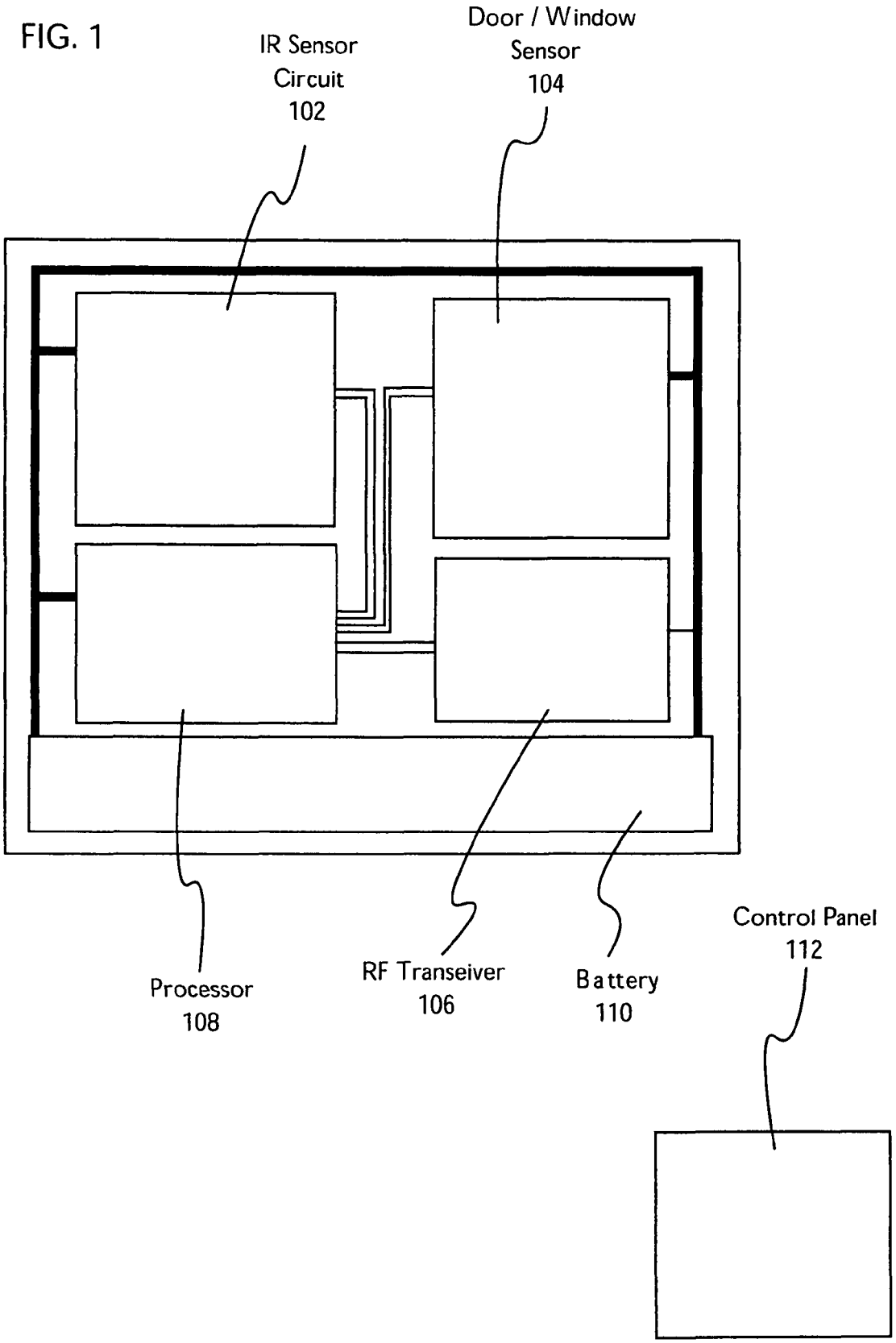
FIG. 1 illustrates a schematic representation of a contact sensor in accordance with the present invention.

As shown in FIG. 1, an embodiment of the present invention includes four components. The first component is a low power passive infrared (IR) sensor circuit 102. The second component is a door/window sensor 104. The third component is an RF transceiver 106. A processor 108 forms the fourth component of the present embodiment. A single battery 110 provides power to all the components.

The IR sensor circuit 102 monitors a predefined area near a door or window for motion. If the IR sensor circuit 102 detects motion, a signal is sent to the processor 108. This signal is used as an inhibit signal to the door/window sensor 104 and prevents the door/window sensor 104 from sending fault signals to a control panel 112 or a remote monitoring station (not shown). However, if the door is opened without motion being detected inside by the IR sensor circuit 102, a fault signal is sent to the control panel 112 and processed accordingly.

The motion detector may be configured to detect all motion in the vicinity of the entry point, or motion of people but ignore the motion of pets. Additionally the motion detector may be configured to determine direction of travel relative to the entry point. In other words, the motion detector may be configured to determine if a person is walking towards the entry point, or away from the entry point; and based on this determination specific security related functions are performed. In addition, the motion detector of the present invention is not limited to I/R sensors but may include any motion sensing technology known in the art, such as charge-coupled device based sensors, etc.

The processor 108 monitors the IR sensor circuit 102 and the door/window sensor 104. If the door/window sensor 104 detects that the door or window is open the processor 108 sends a fault signal via the RF transceiver 106.

Alternatively, the IR sensor circuit 102, or motion detector, may be housed separately from the contact sensor. In such a case the motion detector may be configured to transmit signals related to detected motion either to the door/window sensor 104, the control panel 112, or both. Additional motion detectors may be employed in such a case as well to provide more complete coverage of the area proximate to the entry point.

Additionally, in situations where multiple motion detectors and contact sensors are used to secure a structure, individual motion detectors may be associated with individual door/window sensors 104. Such an association can be created based on uniquely assigned identifiers, such as serial numbers. The motion detectors and door/window sensors 104 in this alternative embodiment are adapted for storing a unique identifier and transmitting the unique identifiers to the control panel 112.

The control panel 112 then considers signals received from a door/window sensor 104 only with signals received from one or more motion detectors associated with the particular door/window sensor 104. Thus, motion detectors can be placed and aligned in a structure such that motion detected by a particular motion detector directly corresponds to an entry point secured by a particular door/window sensor 104. In this way, the security system can differentiate between motion related to one entry point and motion related to a second entry point.

For example, consider the case in which an occupant is inside a monitored structure and makes some motion towards a first monitored entry point, while simultaneously an intrusion is detected at a second entry point nearby. If the motion detectors and door/window sensors are not associated with each other, the security system may consider the detected intrusion at the second entry point to be a result of an action taken by the occupant whose motion was detected, and thus no alarm would be sounded.

However, with associated motion detectors and door/window sensors, a first motion detector, which detected motion of the occupant, can be oriented to only monitor an area corresponding to a first door/window sensor, while other motion detectors can be oriented to monitor other door/window sensors placed on other entry points. Consequently, when the first motion detector detects the motion of the occupant, the security system will only override the intrusion signal of the associated first door/window sensor. In this way, issuance of an intrusion signal by the first door/window sensor would not result in an alarm, while any intrusion signals received from any of the other door/window sensors associated with other motion detectors would trigger alarms as usual.

Moreover, the unique identifiers can be used by the control panel to associate particular motion detectors and door/window sensors with specific security zones or locations within the secured structure. In this way, the control panel can facilitate arming and disarming of individual sensors and zones.

Figure 2:
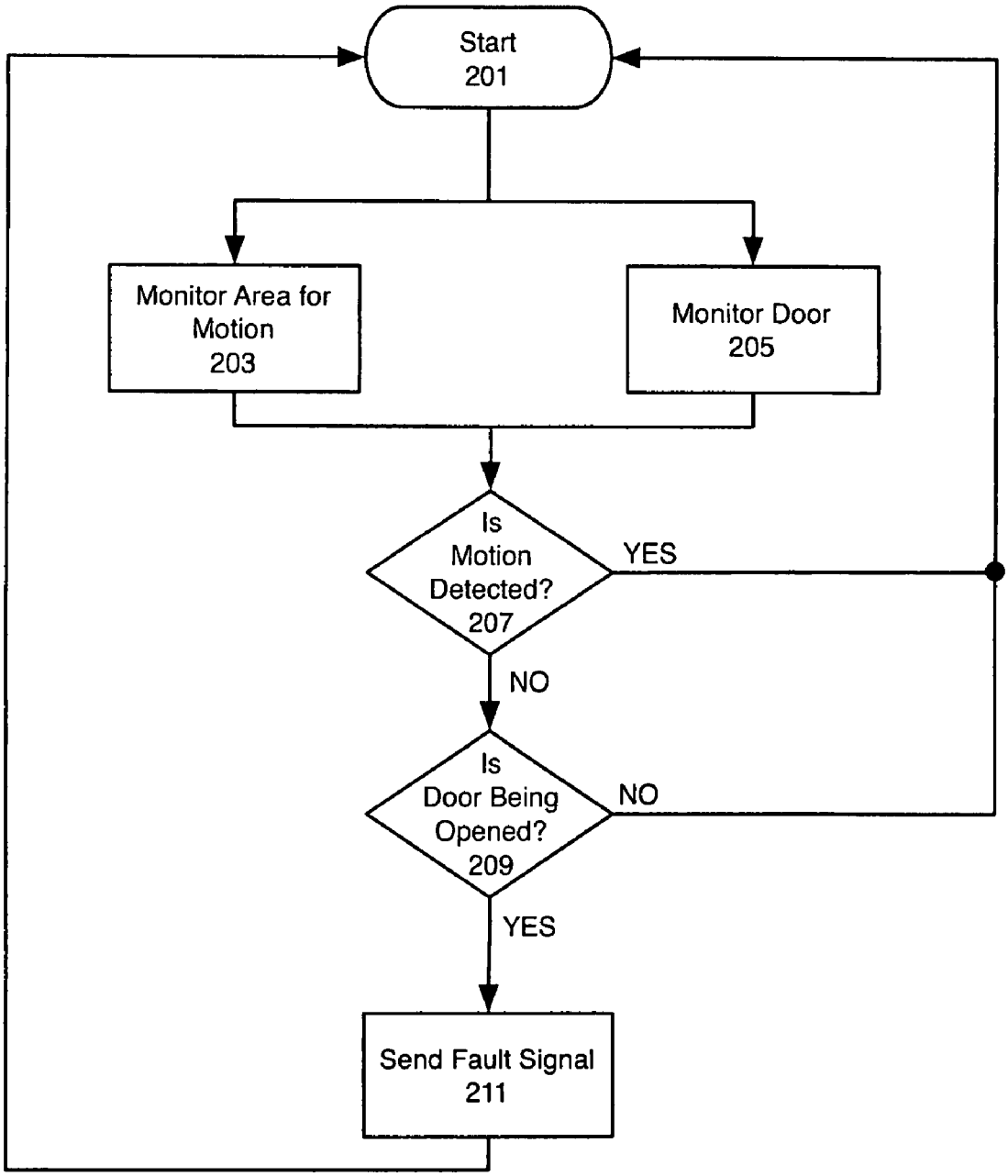
FIG. 2 illustrates a flow diagram of the steps performed by an embodiment of the present invention.

Referring to FIG. 2, a flowchart is shown providing the process for operating an embodiment of the present invention. The process described herein operates in a continuous loop. The system is started in step 201 and the door sensor monitors an area in proximity of the door sensor for motion in step 203, while simultaneously, or nearly so, monitoring the door or window to detect door or window opening in step 205.

When motion is detected in step 207, the process returns to step 201. Thus, when motion is detected, the process ignores the status of the door monitor. However, if no motion is detected in step 207, the process proceeds to step 209, where the status of the monitored door or window is determined.

When the door or window is being opened in step 209, the process proceeds to step 211. At step 211 the process sends a fault signal to a control panel. Once the fault signal is sent, the process returns to step 201. However, if in step 209 it is determined that the door or window is not being opened, the process returns directly to step 201 without sending a fault signal.

While the present invention as shown in FIG. 2 the status of the door monitor when motion is detected near the monitored door is ignored, other methods of preventing generation of an alarm by the security system based on detection of motion are also envisioned. For example, a control panel may be adapted to receive both signals indicating motion detection and signals indicating door opening. However, the control panel only generates an alarm when receipt of the signal indicating opening of the monitored door is not preceded by receipt of a signal indicating motion near the monitored door.

Alternatively, the motion detector may be configured to determine whether a person is moving towards the or away from the motion detector. Such a motion detector may include an infrared sensor and Doppler technology to determine motion and direction relative to the motion detector.

The infrared sensor detects motion across the field of view of the motion detector. While Doppler technology is employed to determine motion towards or away from the motion detector. Thus, if the motion detector is aligned facing a monitored door or window, the motion of the person can be categorized as either moving towards or away from the monitored door or window. In this way, a determination can be made regarding whether the person is approaching the monitored entry point, moving away from the monitored entry point, or passing by the monitored entry point, and act accordingly.

Additionally, the motion detector may be configured to exclude motion originating from a pet, such as a dog or cat. In this way, false motion detection inside the room can be avoided. The pet exclusion feature may be implemented by configuring the motion detector to ignore motion that occurs below a threshold height. Alternatively, pet exclusion can be implemented using a combination of sensors including infrared and microwave sensors, as disclosed in U.S. Pat. No.

5,473,311. Other methods of pet exclusion well known in the art may be implemented as well.

Figure 3:
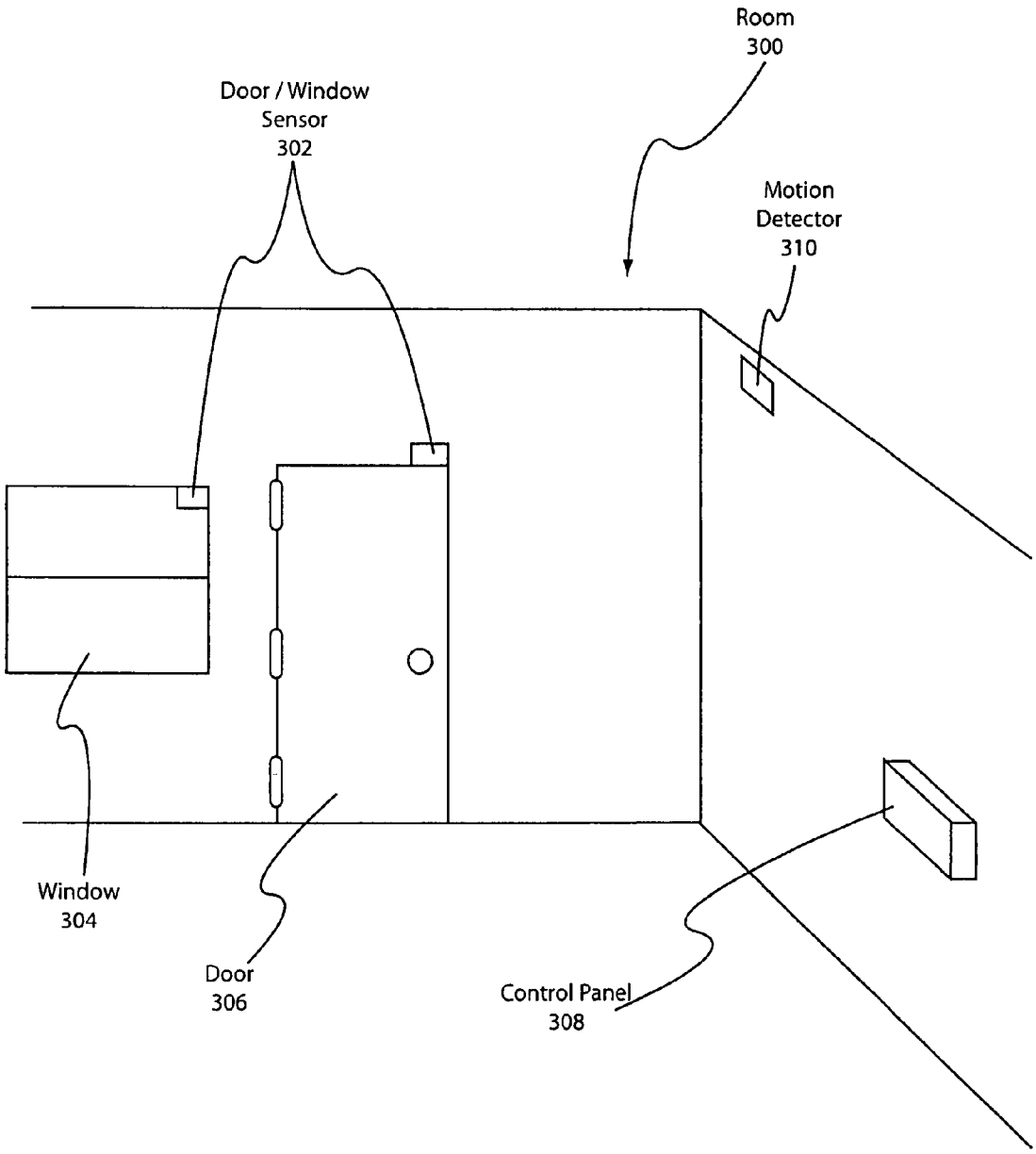
FIG. 3 illustrates a security system using the contact sensor of the present invention.

FIG. 3 shows an exemplar room 300 in which the door/window contact sensor 302 of the present invention is installed. The door/window contact sensor 302 is adapted for installation on either a door 306 or window 304. Additionally, a control panel 308 is provided within wireless communication range of the door/window contact sensors 302. In FIG. 3 the control panel 308 is shown in the room 300 with the door/window contact sensors 302, however the control panel may be situated in any room provided the control panel 308 and door/window contact sensor 302 are able to wirelessly communicate with one another. In cases where the motion detector 310 is housed in a separate unit from the door/window sensor 302, the motion detector 310 is mountable on a ceiling or wall. The motion detector 310 is also capable of wireless communicate with the control panel 308.

While IR sensors and motion detectors have been discussed throughout, any sensor adapted for detecting a presence of an occupant, such as acoustic, imaging and heat sensors are contemplated as being adequate for functioning in place of the disclosed motion detectors.

The described embodiments of the present invention are intended to be illustrative rather than restrictive, and are not intended to represent every embodiment of the present invention. Various modifications and variations can be made without departing from the spirit or scope of the invention as set forth in the following claims both literally and in equivalents recognized in law.

What is claimed is:

1. A sensor system for a security system for monitoring a structure, said sensor system comprising:

a housing;

a sensor within the housing for detecting an opening of an entry point into said structure;

at least one detector within the housing for detecting a presence of an occupant in an area inside of said structure proximate to said entry point; and a controller within the housing directly connected to the sensor and the at least one detector that generates an alarm activation signal in response to said sensor detecting said opening of said entry point while simultaneously not detecting the presence of said occupant, wherein said controller prevents said generation of said alarm activation signal in response to said sensor detecting said opening while said detector simultaneously detects said presence of said occupant.

2. The sensor system as in claim 1, wherein said detector is a heat sensor.

3. The sensor system as in claim 1, wherein said detector is a motion detector.

4. The sensor system as in claim 3, wherein said motion detector determines direction of said motion with respect to said motion detector.

5. The sensor system as in claim 4, wherein said direction is determined based on a Doppler effect.

6. The sensor system as in claim 1, wherein said detector is configured to detect said presence of a human and ignore said presence of pets.

7. The sensor system as in claim 1, further comprising a transmitter for transmitting a signal to said security system, said signal corresponding to said alarm activation signal.

8. The sensor system as in claim 7, wherein said transmitter is a wireless transmitter.

9. The sensor system as in claim 1, wherein said at least one detector has a uniquely assigned first identifier and said sensor has a uniquely assigned second identifier, said first identifier and second identifier being used to associate said detector with a corresponding said sensor.

10. The sensor system as in claim 1, wherein said security system generates an alarm when said alarm activation signal is received by said security system.

11. The sensor system as in claim 1, wherein said controller is included in a control panel of said security system.

12. The sensor system as in claim 1, wherein said controller is included in a housing of one of said sensor and said detector.

13. A method for securing a structure, said method comprising:

monitoring a presence of an occupant from a housing in an area inside of said structure proximate to an entry point into said structure by a detector within the housing;

monitoring a status of said entry point by a sensor within the housing;

generating an alarm activation signal within the housing by a processor directly connected to said detector and said sensor in response said sensor detecting an opening of said entry point while said occupant presence is simultaneously not detected;

generating an alarm within the housing when said alarm activation signal is generated;

transmitting said alarm activation signal to a remotely located alarm panel; and blocking said alarm generation within the housing when said occupant presence is simultaneously detected prior to said alarm activation signal generation.

14. The method as in claim 13, further comprising associating a first unique identifier stored on said detector with a second unique identifier stored on said sensor, said blocking occurring only when said presence is detected by said detector having said first unique identifier associated with said second unique identifier of said sensor generating said alarm activation signal.

15. The method as in claim 13, further comprising transmitting a signal to a security system, said signal corresponding to said alarm activation signal, said security system generating said alarm.

16. The method as in claim 15, wherein said signal is transmitted wirelessly.

17. The method as in claim 15, wherein said blocking prevents said signal corresponding to said alarm activation signal from being transmitted to said security system when said presence is detected.

18. The method as in claim 15, wherein said blocking is performed in said security system, said security system blocking said generation of said alarm when said detector detects said presence.

19. The method as in claim 13, wherein said detector is a heat detector.

20. The method as in claim 13, wherein said detector is a motion detector.

21. The method as in claim 20, wherein said motion detector determines direction of said motion with respect to said motion detector.

22. The method as in claim 21, wherein said direction is determined based on a Doppler effect.

23. The method as in claim 13, wherein said detector is configured to detect said presence of a human and to ignore said presence of pets.

24. A security system for securing a structure, comprising:

a control panel for controlling detectors and sensors adapted for detecting security breaches in a structure, said control panel generating an alarm in response to receiving an alarm activation signal from one of said detectors and said sensors; and at least one sensor system for detecting an opening of an entry point into said structure to which said sensor is attached and generating said alarm activation signal when said opening is detected, said sensor system comprising:

a housing remotely located from said control panel;

a sensor within the housing for detecting said opening of said entry point;

a detector within the housing for detecting a presence of an occupant in an area inside of said structure proximate to said entry point; and a controller within the housing directly connected to said sensor and said detector, said controller generating said alarm activation signal in response to said sensor detecting said opening of said entry point while simultaneously not detecting said occupant, said controller blocking said generation of said alarm activation signal in response to said sensor detecting said opening of said entry point while said detector simultaneously detects said presence.

25. The security system as in claim 24, wherein said control panel blocks generation of said alarm in response to receipt of said alarm activation signal when said detector detects said presence.

26. The security system as in claim 24, further comprising a transmitter disposed at said contact detector for transmitting said alarm activation signal to a receiver disposed in said control panel.

27. The security system as in claim 26, wherein said transmitter is a wireless transmitter and said receiver is a wireless receiver.

28. The security system as in claim 24, wherein said at least one detector has a uniquely assigned first identifier and said contact sensor has a uniquely assigned second identifier, said first identifier and second identifier being used to associate said motion detector with a corresponding said contact sensor.

29. The security system as in claim 24, wherein said detector is a heat sensor.

30. The sensor system as in claim 24, wherein said detector is a motion detector.

31. The sensor system as in claim 30, wherein said motion detector determines direction of said motion with respect to said motion detector.

32. The sensor system as in claim 31, wherein said direction is determined based on a Doppler effect.

33. The sensor system as in claim 24, wherein said detector is configured to detect said presence of a human and ignore said presence of pets.

* * * * *